US006338444B1

(12) United States Patent
Swan

(10) Patent No.: US 6,338,444 B1
(45) Date of Patent: Jan. 15, 2002

(54) SPRAY NOZZLE

(75) Inventor: Trevor William Bartlett Swan, Over (GB)

(73) Assignee: Lurmark Limited (GB)

( * ) Notice: Subject to any disclaimer, the term of this patent is extended or adjusted under 35 U.S.C. 154(b) by 0 days.

(21) Appl. No.: 09/544,967

(22) Filed: Apr. 7, 2000

Related U.S. Application Data

(63) Continuation of application No. PCT/GB98/02974, filed on Oct. 5, 1998.

(30) Foreign Application Priority Data

Oct. 7, 1997 (GB) ..... 9721297

(51) Int. Cl.[7] ..... E03C 1/08

(52) U.S. Cl. ..... 239/428.5; 239/429; 239/433; 239/434.5

(58) Field of Search ..... 239/428.5, 429, 239/432, 433, 434.5

(56) References Cited

U.S. PATENT DOCUMENTS

| | | | | | |
|---|---|---|---|---|---|
| 724,008 | A | * | 3/1903 | Higgins | 239/429 |
| 1,494,009 | A | * | 5/1924 | Napolitan | 239/432 |
| 1,826,776 | A | * | 10/1931 | Gunther | 239/432 |
| 3,784,111 | A | * | 1/1974 | Piggott | 239/432 |
| 3,829,013 | A | * | 8/1974 | Ratnik | 239/432 |
| 4,828,182 | A | | 5/1989 | Haruch | 156/241 |
| 4,925,109 | A | | 5/1990 | Flanagan et al. | 314/856 |
| 5,492,655 | A | * | 2/1996 | Morton et al. | 239/432 |

FOREIGN PATENT DOCUMENTS

| | | | |
|---|---|---|---|
| DE | 1609197 | 1/1965 | |
| DE | 2309801 | 2/1973 | |
| DE | 8703181 | 2/1987 | |
| DE | 19507365 | 3/1995 | |
| DK | 125809 | 5/1919 | |
| EP | 0225193 | 10/1987 | B05B/7/04 |
| EP | 0719590 | 3/1996 | B05B/7/12 |
| GB | 2157591 | 10/1985 | B05B/7/10 |
| GB | 2256817 | 12/1992 | B05B/7/26 |
| WO | WO9507761 | 3/1995 | B05B/7/04 |

* cited by examiner

*Primary Examiner*—David A. Scherbel
*Assistant Examiner*—Dinh Q. Nguyen
(74) *Attorney, Agent, or Firm*—Conley, Rose & Tayon, P.C

(57) ABSTRACT

A spray nozzle has a pre-chamber and a mixing region. A first inlet defines a first fluid flow path for admittance of a first fluid to the pre-chamber. A second inlet defines a second fluid flow path which is crossed by the first fluid flow path for admittance of a second fluid to the pre-chamber. A wall is positioned between the pre-chamber and the mixing region and has an aperture therethrough coaxial with the first fluid flow path. Fluid can pass from the mixing region out of the spray nozzle through an outlet, the outlet not lying on the first and second fluid flow paths. A first fluid entering through the first inlet mixes with a second fluid entering through the second inlet in the mixing region prior to the mixed first and second fluids passing out through the outlet.

20 Claims, 5 Drawing Sheets

SPRAY NOZZLE

RELATED APPLICATIONS

This is a continuation of International Application PCT/GB98/02974, with an international filing date of Oct. 5, 1998 which claims priority from GB 9721297.1 and has a priority date of Oct. 7, 1997.

STATEMENT REGARDING FEDERALLY SPONSORED RESEARCH OR DEVELOPMENT

Not applicable.

TECHNICAL FIELD OF THE INVENTION

The present invention relates to a spray nozzle.

BACKGROUND OF THE INVENTION

Various forms of agricultural spray nozzles are known. In each, a liquid such as a fertiliser or pesticide is supplied to the spray nozzle. The spray nozzle breaks up the liquid into droplets on exiting through an outlet provided in the spray nozzle tip. The spray nozzles may produce various different spray patterns, such as a flat spray pattern, a "solid" cone of drops, a "hollow" cone of drops, etc.

Various spray nozzles have been produced which attempt to provide a better dispersion of the liquid being sprayed in order to reduce the amount of liquid used per unit area of crop in order both to keep down costs and also to minimise any adverse effect on the environment.

In the spray nozzle marketed by the present applicant as "TurboDrop," a flow of liquid through the spray nozzle passes through a venturi restriction which causes air to be entrained with the liquid flow, the air being drawn in through an air inlet in the side of the spray nozzle assembly. The liquid and entrained air pass into a relatively long mixing chamber. The liquid and air mix and air-filled droplets form when the mixed liquid and air pass out through the spray tip in a selected spray pattern. The air-filled droplets tend to drift much less than droplets produced by conventional spray apparatus and provide excellent coverage of an area.

A similar device is disclosed in GB-A-2256817 in which liquid passes into a convergent inlet end of a venturi in the spray nozzle, there being a gas inlet to that convergent inlet end of the venturi. The venturi itself is relatively long and passes to a so-called mixing chamber though it is understood that mixing will take place in the venturi as well as in the mixing chamber itself.

In each of these prior art spray nozzles, each of which relies on the venturi effect, the venturi or mixing chamber has to be relatively long in order to ensure that sufficient mixing of the liquid with the entrained air is achieved to allow turbulence to be created so as to provide air-filled liquid droplets. The venturi/mixing chamber also has to be long in order to prevent liquid passing straight out of the nozzle; in other words, there must be sufficient time for mixing to occur before liquid exits the spray nozzle. This means that these prior art spray nozzles as a whole are long.

The length of the prior art spray nozzles is a problem in the field because the spray nozzles are mounted on booms that are either carried by or towed by a tractor, for example. Such booms are usually folded for storage or and for transit between spraying areas. The long prior art spray nozzles are easily knocked off when the booms are folded.

Moreover, it is usually recommended to use a liquid supply pressure of typically 7 bar (approximately 700 kPa) for some of the prior art spray nozzles. Such high pressures (compared to a typical value of 3 bar (approximately 300 kPa) for conventional spray nozzles) require expensive powerful pumps. Such high pressures can also cause damage to the spray components that incorporate the spray nozzle assembly. Moreover, the long mixing chambers/venturi make these prior art spray nozzles difficult to clean. This is compounded by the fact that, in practice, such spray nozzles will typically be covered in mud as a result of having been carried behind a tractor.

Another type of prior art spray nozzle is a so-called twin fluid nozzle. A liquid is forced into a mixing and atomising chamber in the spray nozzle and typically strikes a plate provided within the chamber. Pressurised air is forced into the chamber to carry the liquid out of the chamber outlet to a spray nozzle outlet where the liquid atomises and droplets issue as a spray. It should be noted that the air is forced into the chamber in a twin fluid nozzle rather than being drawn in by movement of liquid through the chamber as in a venturi nozzle. Examples of twin fluid nozzles are disclosed in EP-A-0225193, GB-A-2157591, WO-A-96/20790 and U.S. Pat. No. 4,828,182.

SUMMARY OF THE INVENTION

According to a preferred embodiment of the present invention, the present spray nozzle comprises a pre-chamber and a mixing region, a first inlet defining a first fluid flow path for admittance of a first fluid to the pre-chamber, a second inlet defining a second fluid flow path that is crossed by the first fluid flow path for admittance of a second fluid to the pre-chamber, a wall between the pre-chamber and the mixing region and having an aperture therethrough coaxial with the first fluid flow path, and an outlet from the mixing region through which fluid can pass from the mixing region out of the spray nozzle. The outlet does not lie on either the first or second fluid flow paths, such that in use a first fluid entering through the first inlet mixes with a second fluid entering through the second inlet in the mixing region before the mixed first and second fluids passing out through the outlet.

The aperture in the wall between the pre-chamber and the mixing region allows fluid to pass from the pre-chamber to the mixing region, while the wall itself tends to prevent fluid in the mixing region passing back to and out of the second inlet. In the preferred embodiment, the wall defines the pre-chamber positioned upstream of the mixing region and into which the first and second inlets open. In a venturi nozzle where air is drawn in as the second fluid through the second inlet, the size of the aperture in the wall can be adjustable to allow some degree of control over the amount of air that is drawn in through the second inlet. The pre-chamber helps to keep down the overall length of the nozzle by promoting more efficient mixing of the first and second fluids.

A first end of the second inlet is preferably open to atmosphere and a second end of the second inlet preferably opens to a position adjacent the first fluid flow path, whereby passage of a first fluid through the first inlet causes air to be drawn in through the second inlet.

Alternatively, there may be means for connecting the second inlet to a supply of pressurised air.

The spray nozzle may have a wall opposite the first inlet and transverse to the first fluid flow path, with the wall having an aperture defining the outlet that is offset from the first fluid flow path. The aperture of the wall between the pre-chamber and the mixing region preferably has a cross-sectional area that is greater than the cross-sectional area of the first inlet.

The first inlet preferably includes two first inlet apertures. In this embodiment, the wall between the pre-chamber and the mixing region preferably has two apertures therethrough, which are respectively coaxial with the two first inlet apertures. The use of two inlet apertures helps to ensure that the pattern of fluid exiting the outlet in use is symmetrical, ensuring more uniform coverage during spraying. The inlet apertures are preferably symmetrically spaced either side of a central longitudinal axis of the spray nozzle.

The second fluid flow path is preferably perpendicular to the first fluid flow path. The second inlet preferably comprises two second inlet apertures.

The outlet may lie on a central longitudinal axis of the spray nozzle.

The spray nozzle is preferably provided in two parts, the first part having the first and second inlets, the second part having the outlet. The use of two parts means that the size of the outlet can be altered easily by using a different outlet part having a different size outlet. The use of two parts also facilitates cleaning of the nozzle.

According to a second aspect of the present invention, there is provided a method of spraying using a spray nozzle having a pre-chamber and a mixing region, a first inlet defining a liquid flow path for admittance of a liquid to the pre-chamber, a second inlet defining an air flow path that is crossed by the liquid flow path for admittance of air to the pre-chamber, a wall between the pre-chamber and the mixing region and having an aperture therethrough coaxial with the liquid flow path, and an outlet from the mixing region, through which mixed liquid and air can pass from the mixing region out of the spray nozzle. Again, the outlet preferably does not lie on the liquid and air flow paths. The method comprises the steps of passing a liquid through the liquid inlet, mixing said liquid with air entering through the second inlet in the mixing region, and passing mixed liquid and air out through the outlet.

BRIEF DESCRIPTION OF THE DRAWINGS

An embodiment of the present invention will now be described by way of example with reference to the accompanying drawings, in which.

DETAILED DESCRIPTION OF A PREFERRED EMBODIMENT

In FIGS. 1A to 1E, there are shown various views of an inlet part 10 of a first example of a spray nozzle 1 according to a preferred embodiment of the present invention. In FIGS. 2A to 2E, there are shown various views of an outlet part 30 of the spray nozzle 1. The assembled inlet and outlet parts 10 and 30 are shown in FIGS. 3A to 3E and 4A.

Figure 1D:
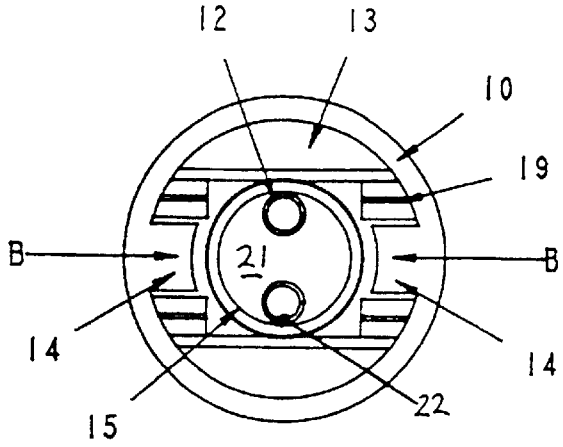
FIGS. 1A to 1E are respectively a view from an inlet end, a first side view, a first longitudinal cross-sectional view, a view from the outlet end of an inlet part, and a second side view of a first example of a spray nozzle according to the present invention.
Figure 1E:
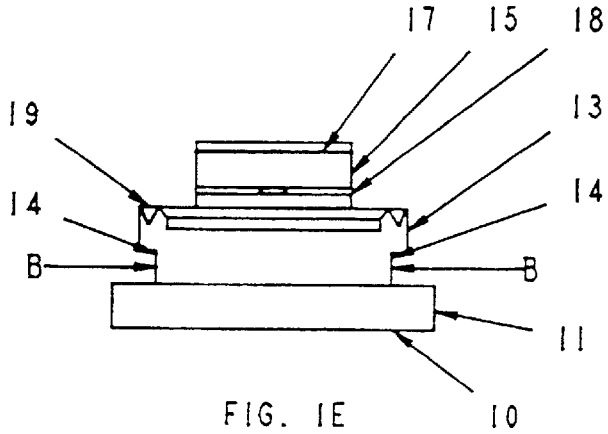
Figure 1B:
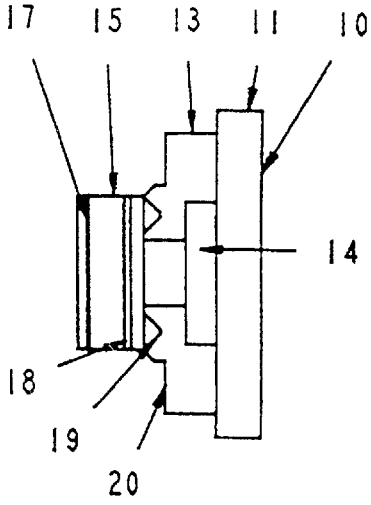
Figure 1A:
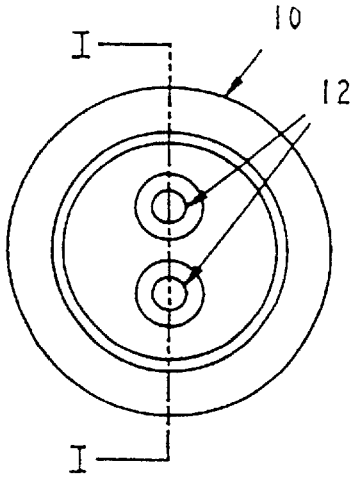
Figure 1C:
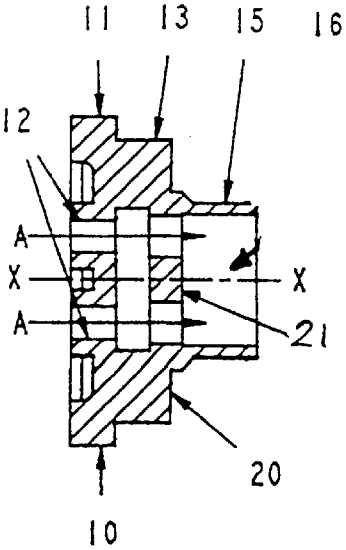

Referring initially to FIGS. 1A to 1E, the inlet part 10 generally has a circular cross-sectional shape having reduced stepped outer diameters as shown particularly clearly in the side views FIGS. 1B, 1C and 1E. FIG. 1C is a cross-section on lines I—I of FIG. 1A.

The base portion 11 of the inlet part 10 has the greatest external diameter and has two apertures or through holes 12 therethrough, which define first inlets for a first fluid. The through holes or first fluid inlets 12 pass through the base portion II in a direction parallel to the central longitudinal axis X—X of the inlet part 10. The first fluid inlets 12 are symmetrically placed either side of the central longitudinal axis X—X of the inlet part 10 and so are positioned at an equal spacing on opposite sides of the central longitudinal axis X—X. The first fluid inlets 12 define flow paths A for the first fluid in a direction parallel to the central longitudinal axis X—X of the inlet part 10.

A second or intermediate portion 13 of reduced external diameter is adjacent the base portion 10. Opposite sections of the wall defining the second or intermediate portion 13 are relieved or absent so as to provide opposed second inlets 14 for a second fluid to enter through the second fluid inlets 14 into the hollow centre 16 of the inlet part 10 in a direction B transverse to the first fluid flow paths A. As can be seen from the drawings, the second fluid inlets 14 open onto the first fluid flow paths A and are thus crossed by flow of the first fluid through the first fluid inlets 12. The second fluid inlets 14 are at a position which is rotated through 90° around the longitudinal axis X—X relative to the first fluid inlets 12. In the embodiment shown, the second fluid inlets 14 are open to atmosphere.

The intermediate portion 13 of the inlet part 10 leads onto a final portion 15 of reduced external diameter. This final portion 15 defines therein a hollow cylindrical volume 16 which will be discussed further below. The end portion 15 of the inlet part 10 has a first external annular bead 17 and a second external annular bead 18.

In this example, the intermediate portion 13 of the inlet part 10 has four locating wedge-shape recesses 19 facing in a direction parallel to the longitudinal axis X—X on the stepped surface 20 which connects the intermediate portion 13 externally to the final portion 15.

Within the inlet part 10, at a position just downstream of the second fluid inlets 14 and corresponding to the junction between the intermediate portion 13 and final portion 15 of the inlet part 10, is an intermediate wall 21. This intermediate wall 21 has two circular apertures 22 which are coaxial with and of slightly larger diameter than the first fluid inlets 12.

Referring now to FIGS. 2A–E, The outlet part 30 of the spray nozzle 1 has a first circular wall 31 which defines a mixing chamber 32 in the form of a cylindrical central volume 32. The circular wall 31 is sized to fit over the narrow portion 15 of the inlet part 10 and has an internal annular recess 33. The outlet part 30 has wedge-shape teeth 34 which correspond to and are received in the wedge-shape recesses 19 of the inlet part 10 to fix the relative orientation of the two parts 10,30 in the assembled spray nozzle 1.

Figure 2C:
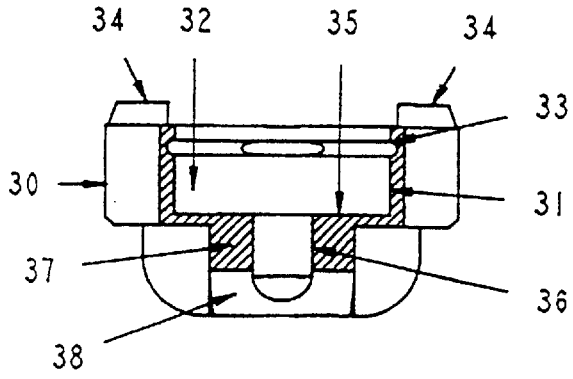
FIGS. 2A to 2E are respectively a view from an outlet end, a first side view, a longitudinal cross-sectional view, a view from an inlet end, and a second side view of an outlet part of the first example of the spray nozzle.
Figure 2E:
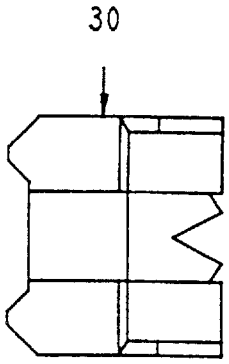
Figure 2A:
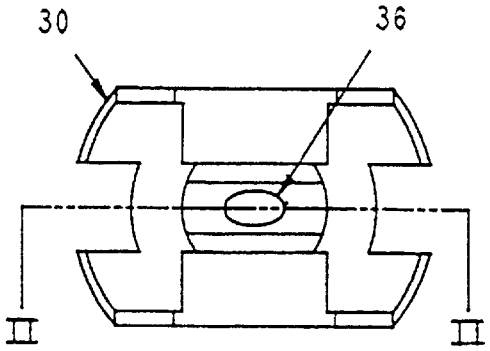
Figure 2B:
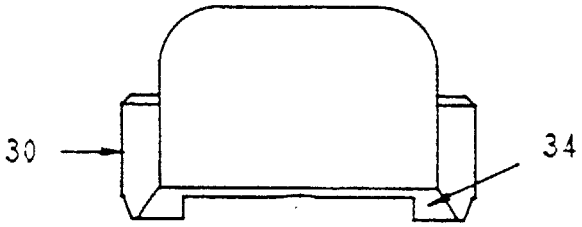
Figure 2D:
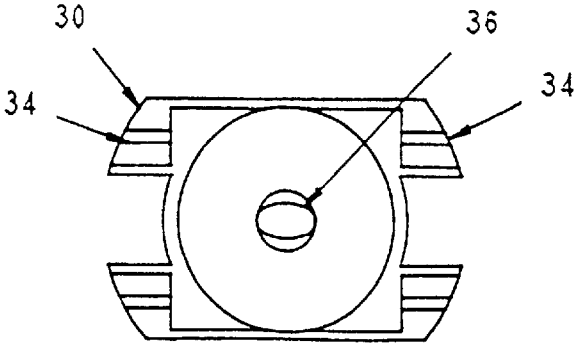
Figure 3E:
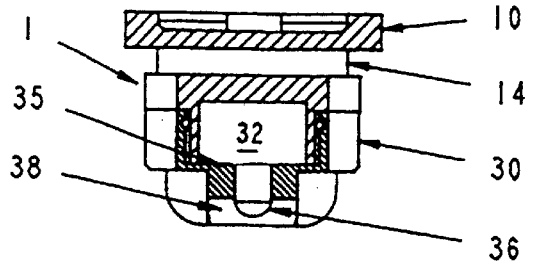
FIGS. 3A to 3E are respectively a view from an outlet end, a first longitudinal cross-sectional view, a first side view, a second side view, and a second cross-sectional view of the first example of the assembled spray nozzle.
Figure 3B:
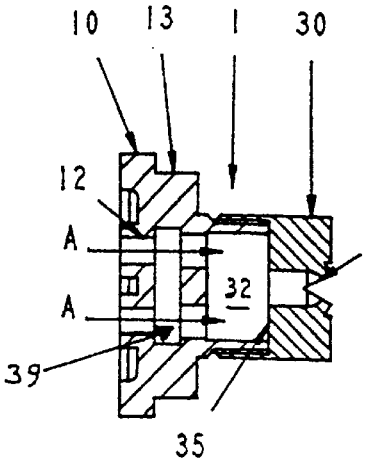
Figure 3A:
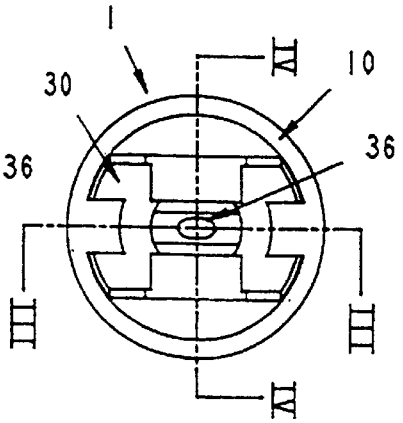
Figure 3C:
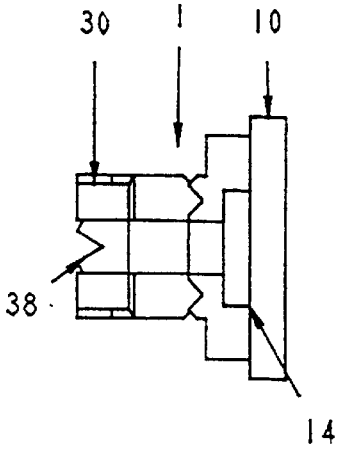
Figure 3D:
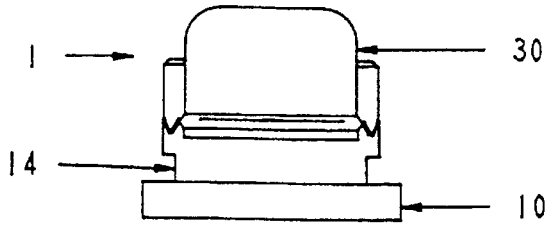
Figure 4A:
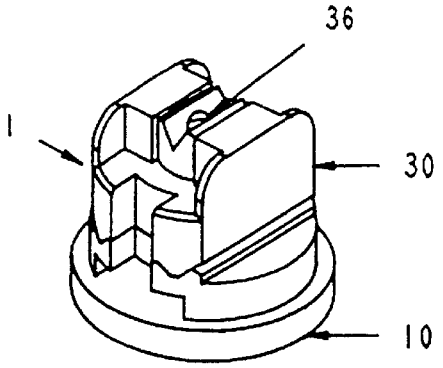
FIGS. 4A and 4B are perspective views of the assembled spray nozzle and the disassembled spray nozzle of the first example respectively.
Figure 4B:
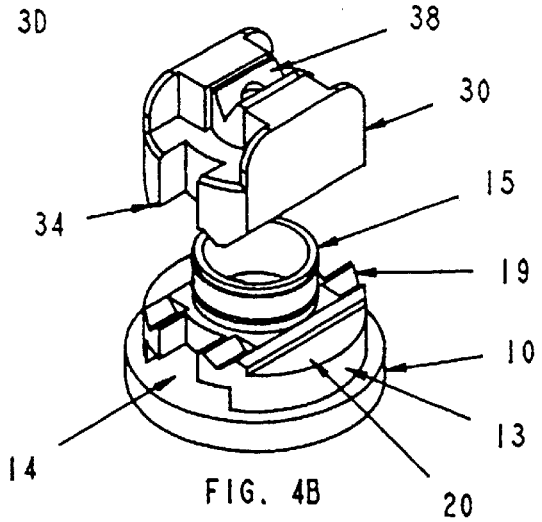

As can be seen particularly clearly in FIG. 2C, which is a cross-sectional view on II—II of FIG. 2A, and in FIGS. 3B and 3E, which are cross-sectional views on IV—IV and III—III of FIG. 3A respectively, the central volume 32 of the outlet part 30 terminates in a wall 35, which is opposite the first fluid inlets 12 in the assembled spray nozzle 1. A through hole 36 is provided centrally of the wall 35 and provides an outlet from the central volume 32. The longitudinal extent of the outlet 36 is defined by a short cylindrical wall 37 running parallel to the central longitudinal axis of the spray nozzle 1. The short wall 37 has a wedge-shape recess 38 which flares outwardly away from the outlet 36 to define a fan spray tip as is well known in the art of spray nozzles. It will be appreciated that the portion of the wall 37 surrounding the outlet 36 can be provided with different shapes in order to provide spray patterns of different shapes, such as cones for example.

In use, the spray nozzle 1 is formed by assembling the inlet and outlet parts 10,30 with the wall of the final portion 15 of the inlet part 10 being received in the central volume 32 of the outlet part 30. The second bead 18 snaps into the annular recess 33 and the first bead 17 provides a seal for the junction of the inlet and outlet parts 10,30. The intermediate wall 21 of the inlet part 10 defines a pre-chamber 39 (FIG. 3B) upstream of the mixing chamber 32. The assembled spray nozzle 1 can then be fitted to an agricultural boom by means of a conventional spray cap (not shown) for example.

A first fluid, which may be a liquid such as a solution of a pesticide or fertiliser for example, is supplied under pressure to the first fluid inlets 12 so that the first fluid flows in the direction indicated by arrows A. The flow of the first fluid transversely past the laterally disposed second fluid inlets 14 draws air in through the second fluid inlets 14 into the pre-chamber 39 and the air is entrained with the first fluid. On passing through the apertures 22 of the intermediate wall 21 into the mixing chamber 32 provided by the volume 32 defined in the outlet part 30, the first fluid strikes the opposed wall 35 of the inlet part 30. It will be appreciated that because the first fluid inlets 12 are offset relative to the outlet 36, there is very little tendency for the first fluid to pass straight out of the outlet 36. The intermediate wall 21 tends to prevent the fluid in the mixing chamber 32 passing back to and out of the second fluid inlets 14.

After striking the wall 35 opposite the first fluid inlets 12, the first fluid having entrained air atomises to produce air-filled droplets on being forced out of the mixing chamber 32 by the action of further incoming first fluid entering the mixing chamber 32 through the first fluid inlets 12 and apertures 22 of the intermediate wall 21. It will be appreciated that this is achieved without requiring a long mixing chamber, in contrast to the prior art spray nozzles of this type. The effective mixing chamber of the present invention is provided by the relatively short volume 32 of the second part 30.

Figure 5A:
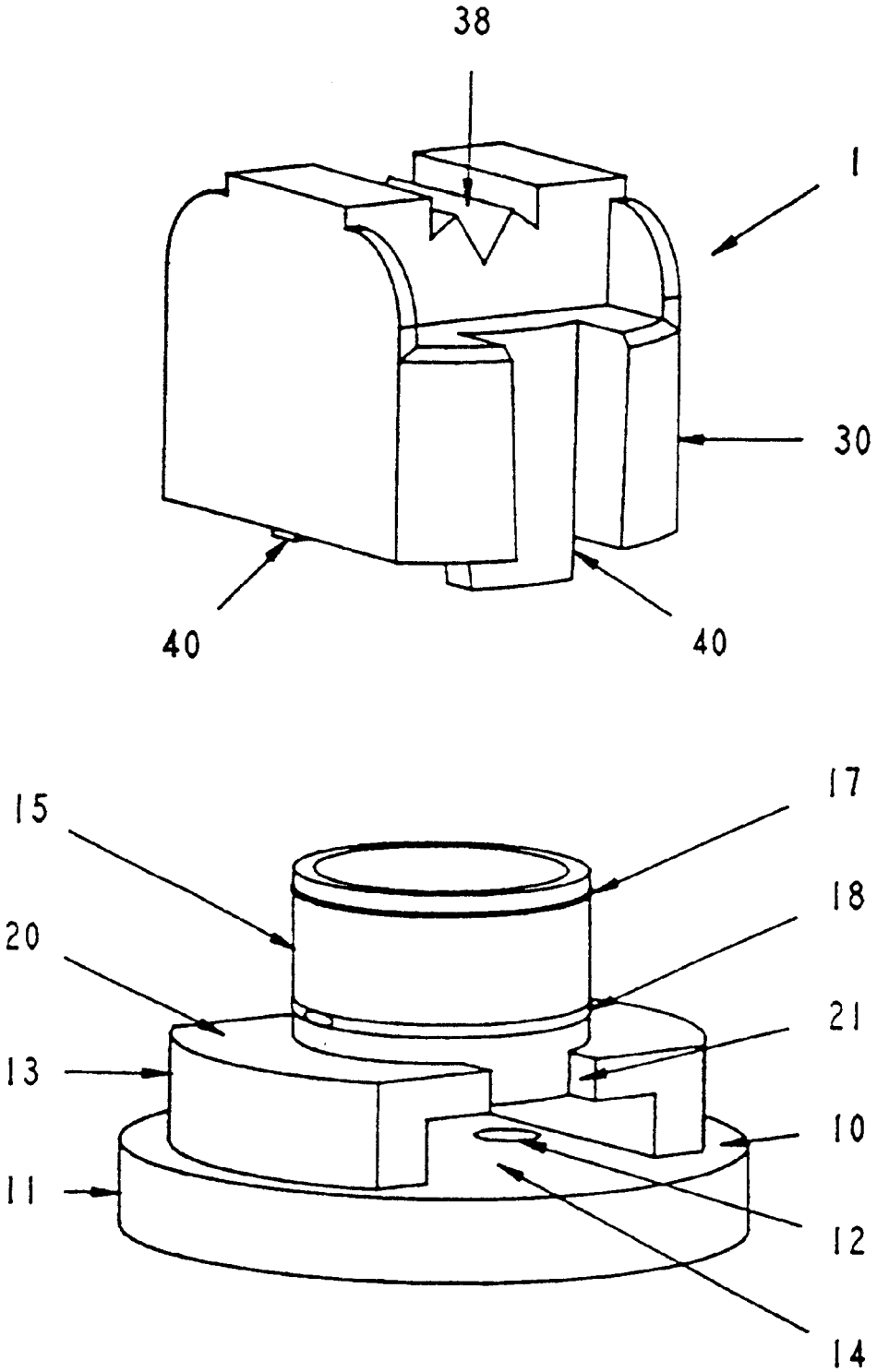
FIGS. 5A and 5B are perspective views of a disassembled spray nozzle and an assembled spray nozzle of an alternative embodiment of the present invention.
Figure 5B:
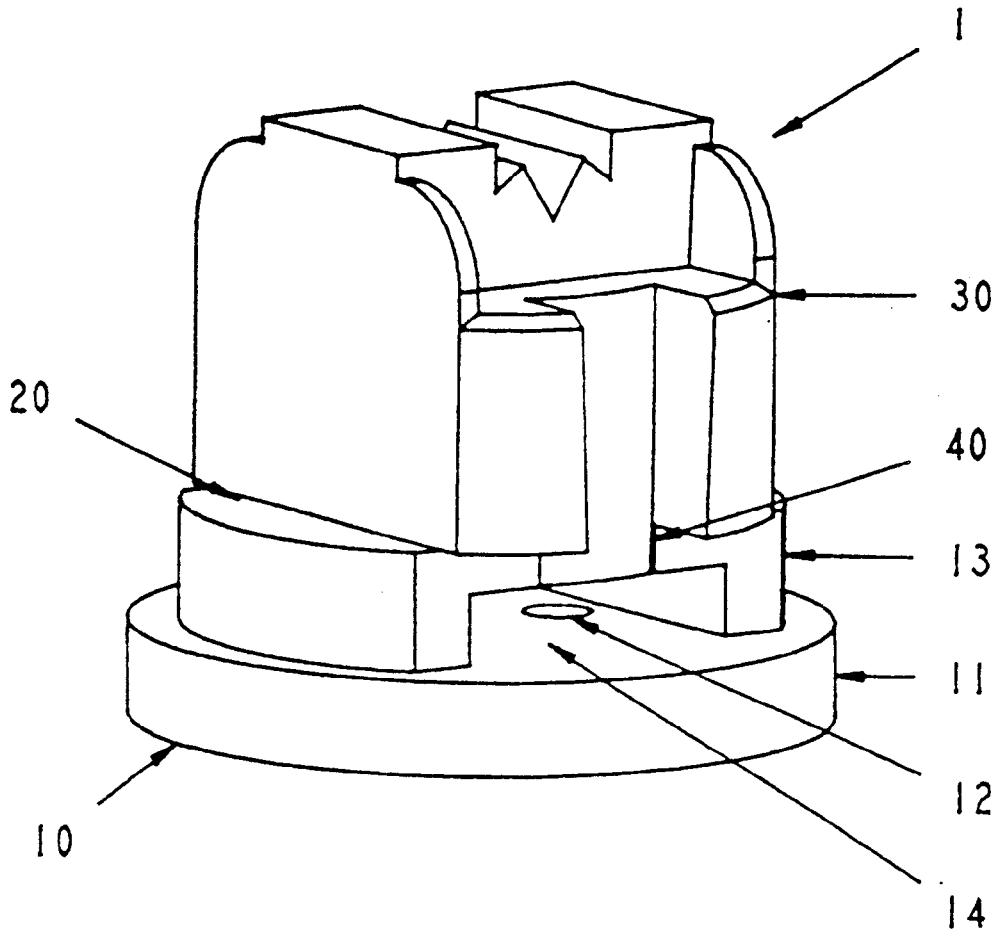

A second example of a spray nozzle 1 in accordance with the present invention is shown in FIGS. 5A and 5B. The second example is similar to the first example described above and those parts which are the same have the same reference numerals and will not be further described.

The second example of the spray nozzle 1 differs in the way relative orientation of the two parts 10,30 is achieved. In the second example of the spray nozzle 1, the wedge-shape recesses 19 and wedge-shape teeth 34 of the first example are replaced by a pair of opposed lugs 40 on the second part 30 which project rearwards of the second part to engage with corresponding opposed recesses 41 provided in the stepped surface 20 which connects the intermediate portion 13 externally to the final portion 15 of the first part 10.

It has been found that the spray nozzle of the present invention can operate at a pressure of only 3 bar (approximately 300 kPa) which is much less than the 7 bar (approximately 700 kPa) required of some prior art spray nozzles of this type as discussed above. A pressure of 3 bar (approximately 300 kPa) is more typical of the pressures used in conventional spraying equipment and therefore the spray nozzle 1 of the present invention is much more convenient for the user. The spray components which incorporate the spray nozzle 1 are much less likely to suffer damage, for example to seals, due to the supply pressure of the first fluid.

It has also been found that the manufacturing tolerances required of the spray nozzle 1 of the present invention are much less stringent than those similar spray nozzles of the prior art. For example, in the "TurboDrop" spray nozzle mentioned above, it is necessary to balance carefully the inlet orifice size compared to the outlet orifice size to within very fine tolerances in order to prevent flooding and liquid outflow through the air inlet. In the present invention, the requirements on manufacturing are much less stringent. The present invention allows the outlet orifice size to be varied relatively freely, which allows much greater freedom in manufacture which in turn enables the ultimate droplet size to be varied simply by providing different outlet parts 30 having different sizes for the outlet 36. Different droplet sizes have different dispersion characteristics and therefore the present invention allows the user to obtain the required dispersion characteristic more easily. In some circumstances, a small droplet size is preferred whereas in other circumstances a larger droplet size is preferred. At present, the reason for the less stringent requirements on manufacturing tolerances is not clear but it is believed to be related to the non-alignment of the inlets and outlets in the spray nozzle 1 of the present invention.

Moreover, the size of the apertures 22 of the intermediate wall 21 can be adjusted to provide some degree of control over the amount of air which is drawn in through the second fluid inlets 14.

The inlet and outlet parts 10,30 can be made of any suitable materials, including plastics such as acetal.

An embodiment of the present invention has been described with particular reference to the examples illustrated. However, it will be appreciated that variations and modifications may be made to the examples described within the scope of the appended claims. For example, more than two first fluid inlets may be provided, there preferably being a corresponding number of apertures in the intermediate wall. More than two second fluid inlets may be provided.

What is claimed is:

1. A spray nozzle, the nozzle comprising a pre-chamber and a mixing region, a first inlet comprising at least two first inlet apertures which define a first fluid flow path for admittance of a first fluid to the pre-chamber, a second inlet defining a second fluid flow path that intersects said first fluid flow path for admittance of a second fluid to the pre-chamber, a wall between the pre-chamber and the mixing region and having a plurality of apertures therethrough which correspond in number to and which are respectively coaxial with said at least two first inlet apertures, and an outlet from the mixing region through which fluid can pass from the mixing region out of the spray nozzle, the outlet not lying on the first and second fluid flow paths such that in use a first fluid entering through the first inlet mixes with a second fluid entering through the second inlet in the mixing region prior to the mixed first and second fluids passing out.

2. A spray nozzle according to claim 1 wherein a first end of the second inlet is open to atmosphere and a second end of the second inlet opens to a position adjacent the first fluid flow path whereby passage of a first fluid through the first inlet causes air to be drawn in through the second inlet.

3. A spray nozzle according to claim 1 wherein the second inlet is connectable to a supply of pressurised air.

4. A spray nozzle according to claim 1 comprising a wall opposite the first inlet and transverse to the first fluid flow path, said wall having an aperture that defines the outlet that is offset from the first fluid flow path.

5. A spray nozzle according to claim 1 wherein each aperture of the wall between the pre-chamber and the mixing region has a cross-sectional area that is greater than the cross-sectional area of the corresponding first inlet aperture.

6. A spray nozzle according to claim 1 wherein said first inlet apertures are symmetrically spaced on either side of a central longitudinal axis of the spray nozzle.

7. A spray nozzle according to claim 1 wherein said first fluid flow path is at a right angle to said second fluid flow path.

8. A spray nozzle according to claim 1 wherein said second inlet comprises two second inlet apertures.

9. A spray nozzle according to claim 1 wherein said outlet lies on a central longitudinal axis of the spray nozzle.

10. A spray nozzle according to claim 1 wherein the spray nozzle is in two parts, the first part including said first and second inlets, the second part including said outlet.

11. A method of spraying using a spray nozzle having a pre-chamber and a mixing region, a first inlet comprising at least two first inlet apertures which define a liquid flow path for admittance of a liquid to the pre-chamber, a second inlet defining an air flow path which is crossed by the liquid flow path for admittance of air to the pre-chamber, a wall between the pre-chamber and the mixing region and having a plurality of apertures therethrough which correspond in number to and which are respectively coaxial with said at least two first inlet apertures, and an outlet from the mixing region through which mixed liquid and air can pass from the mixing region out of the spray nozzle, the outlet not lying on the liquid and air flow paths, the method comprising the steps of passing a liquid through the first inlet, mixing said liquid with air entering through the second inlet in the mixing region, and passing mixed liquid and air out through the outlet.

12. A method according to claim 11 wherein a first end of the second inlet is open to atmosphere and a second end of the second inlet opens to a position adjacent the liquid flow path such that passage of liquid through the first inlet causes air to be drawn in through the second inlet.

13. A method according to claim 11 comprising the step of supplying pressurised air through the second inlet.

14. A method according to claim 11 wherein each aperture of the wall between the pre-chamber and the mixing region has a cross-sectional area which is greater than the cross-sectional area of the corresponding first inlet aperture.

15. A method according to claim 11 wherein the first inlet apertures are symmetrically spaced either side of a central longitudinal axis of the spray nozzle.

16. A method according to claim 11 wherein the liquid flow path is at a right angle to the air flow path.

17. A method according to claim 11 wherein the second inlet comprises two second inlet apertures.

18. A method according to claim 11 wherein the outlet lies on a central longitudinal axis of the spray nozzle.

19. A method according to claim 11, wherein the spray nozzle is in two parts, the first part including the first and second inlets, the second part including the outlet.

20. A spray nozzle, comprising:

an inlet part, said inlet part defining an internal pre-chamber and a mixing region at one end of said inlet part, said inlet part including a first inlet opening into a first fluid flow path for admittance of a first fluid to said pre-chamber and said mixing region, the first inlet comprising at least two first inlet apertures, a second inlet opening into a second fluid flow path that intersects the first fluid flow path for admittance of a second fluid to said pre-chamber and said mixing region, and a wall between said pre-chamber and said mixing region, said wall having a plurality of passages therethrough which correspond in number to and which are respectively coaxial with said at least two first inlet apertures; and an outlet part, said outlet part including a closure member for said mixing region, said closure member including an outlet through which fluid can exit said mixing region, the outlet being not coaxial with said first or second fluid flow paths, such that in use a first fluid entering through the first inlet mixes with a second fluid entering through the second inlet in the mixing region prior to the mixed first and second fluids exiting through said outlet.

* * * * *